US006385834B2

(12) United States Patent
Thermos et al.

(10) Patent No.: US 6,385,834 B2
(45) Date of Patent: May 14, 2002

(54) TOOL FOR REMOVAL AND INSTALLATION OF STAR-WASHERS

(75) Inventors: Anthony Constantine Thermos; Charles Van Buchan, both of Greer, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/681,339

(22) Filed: Mar. 21, 2001

Related U.S. Application Data

(60) Provisional application No. 60/191,101, filed on Mar. 22, 2000.

(51) Int. Cl.[7] ..... B25B 27/14

(52) U.S. Cl. ..... 29/278; 29/270; 29/242

(58) Field of Search ..... 29/278, 270, 220, 29/216, 225, 230, 242–243; 81/177.1, 177.4

(56) References Cited

U.S. PATENT DOCUMENTS

| | | | | | |
|---|---|---|---|---|---|
| 1,927,528 | A | * | 9/1933 | Nilsson | 29/278 |
| 2,346,364 | A | * | 4/1944 | Dowe | 81/177.1 |
| 2,483,379 | A | * | 9/1949 | Brell | 29/278 |
| 4,522,270 | A | * | 6/1985 | Kishi | 81/177.1 |
| 5,909,910 | A | * | 6/1999 | Shaffer | 29/278 |
| 5,956,832 | A | * | 9/1999 | Reagon | 29/278 |

* cited by examiner

*Primary Examiner*—Joseph J. Hail, III
*Assistant Examiner*—Lee Wilson
(74) *Attorney, Agent, or Firm*—Nixon & Vanderhye P.C.

(57) ABSTRACT

A tool for removal of star-washers from a bore includes a handle; and a tool secured to the handle, the tool component having a distal end with an elongated slot extending from the distal end rearwardly toward the handle, and a plurality of hooks circumferentially equally spaced about the distal end.

9 Claims, 2 Drawing Sheets

TOOL FOR REMOVAL AND INSTALLATION OF STAR-WASHERS

CROSS REFERENCE TO RELATED APPLICATIONS

This application claims priority from provisional Application No. 60/191,101, filed on Mar. 22, 2000, the contents of which are incorporated herein in their entirety.

BACKGROUND OF INVENTION

This invention relates to a tool for the removal and installation of star-washers used to secure thermocouples in bearing pads.

A star-washer is a standard commercial washer (coming in different sizes), that is widely used in bearing instrumentation in almost all gas turbine units manufactured by the assignee. Such washers have a plurality of circumferentially spaced, radially extending spring-like tabs that can be pressed into a bore to hold another component in place within the bore. For example, star-washers are used to hold thermocouples within bores in turbine bearing pads.

The installation and removal of such star-washers, however, is very difficult, and can result in destruction of the thermocouple itself, which then subsequently needs to be replaced. The replacement of the thermocouple is not easy and can cause serious delays in the assembly line or in the field. There is a need, therefore, for a reliable tool that can prevent damage to the thermocouple during the process of installation and removal of associated star-washers.

Bearing metal thermocouples (TCs) are required to touch the bearing pad metal in a predrilled "flat bed" blank hole, for accurate reading of the metal temperature. To achieve this objective, the TCs are spring loaded. The spring surrounds the lead wire of the thermocouple, and one end of the spring provides the required compression to the TC's head for good metal contact. The other end of the spring rests on the star-washer. The star-washer is pushed into the hole and is anchored by its radial tabs or tips on the wall of the hole. By pushing the star-washer into the hole, the appropriate compression is provided on the TC for adequate metal to metal contact.

Manufacturing and field operators have attempted to create devices that can remove and install the star-washers without destroying the associated TC's. Most of the time, a metal wire has been used with a hook formed at its end. However, this method is not particularly reliable. A tube has also been used for the TC's installation, but this method has also proven unreliable.

SUMMARY OF INVENTION

The invention provides a tool that can be used to remove as well as to install star-washers without damaging associated TCs. The tool is composed of two small diameter tubes welded together. The tool generally has the shape of a "T". The distal end of the long side of the tool is machined with hooks that are designed to engage the star-washer through the spaces between the radial tips of the star-washer, and to keep the star-washer flat during its removal. Also, this long side of the tool has a slot extending along the tube that is sized to allow the TC lead or leads to exit. The tube is machined to a diameter enabling it to be slip-fit in the hole where the TC is located.

The top part (or short side) of the tool is used as a handle during star-washer removal, but is also used as a tool for TC installation. It has almost the same configuration as the above described long side, except this part does not carry hooks at either end. It is sized on diameter to slip-fit inside the hole and is used to push the star-washer flat down into the hole without damaging or destroying the TC lead or leads.

Variations of the tool are possible, by, for example, creating threaded areas where legs of different diameters can be installed and used for holes and TC's of larger diameters.

Accordingly, in one aspect, the present invention relates to a tool for removal of star-washers from a bore comprising a handle member; and a tubular working member secured to the handle member, the working member having a distal end with an elongated slot extending from the distal end rearwardly toward the handle member, and a plurality of hooks circumferentially equally spaced about the distal end.

In another aspect, the invention relates to a tool for removal of star-washers from a bore comprising a handle member; and a tubular working member secured to the handle member, said working member having a distal end with an elongated slot extending from the distal end rearwardly toward the handle member, and a plurality of hooks circumferentially equally spaced about said distal end; and wherein said handle member comprises a hollow tube, one end of said hollow tube formed with an elongated slot extending from one end of the hollow tube toward the working member.

DETAILED DESCRIPTION

Figure 1:
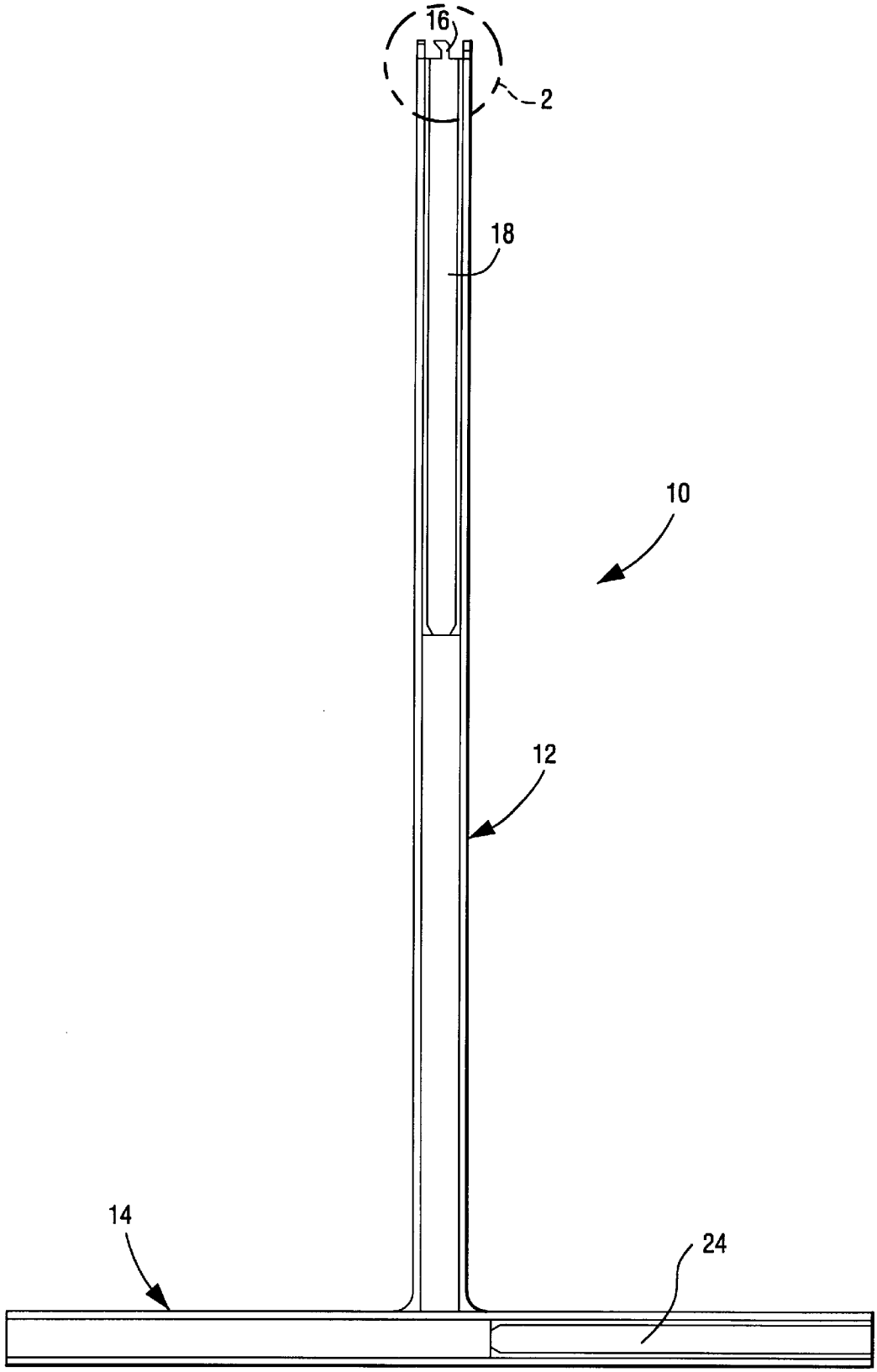
FIG. 1 is a side elevation of the tool in accordance with an exemplary embodiment of the invention.

Referring to FIG. 1, the tool 10 includes a first leg 12 and a second leg 14 arranged perpendicularly with respect to the first leg 12. Leg 14 has a lesser length dimension than leg 12, such that the tool is T-shaped, with leg 12 considered the stem of the T, or long side of the tool, and leg 14 considered the cross-member of the T or short side of the tool. Both legs 12 and 14 may comprise relatively small diameter tubes welded together. A typical diameter for each leg is 0.300±0.005 inch. In an exemplary embodiment, leg 12 may have a length of about 7.50 in. and leg 14 may have a length of about 5 in.

Figure 2:
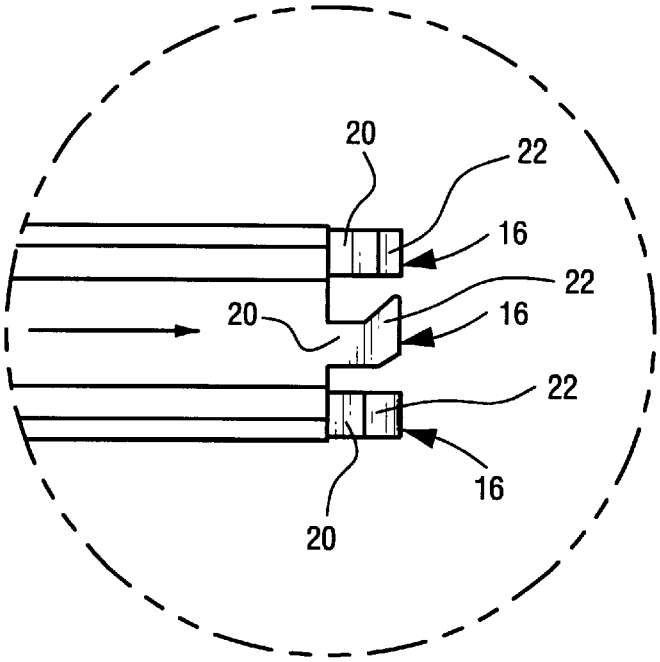
FIG. 2 is an enlarged detail 2 taken from FIG. 1.

As best seen in FIG. 2, leg 12 is machined at its distal or free end to include a plurality of hooks 16 arranged about the periphery of the free end of the leg, but interrupted by a longitudinal slot 18 extending from the distal end rearwardly a distance of about 3.5 in., i.e., approximately half the length of leg 12.

Figure 4:
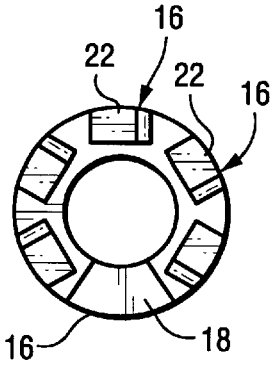
FIG.4 is a schematic plan view of the distal end of the tool shown in FIG. 1, showing the distribution of hooks about the circumference of the distal end.

The hooks 16 each include a forwardly directed stem 20 and a hook portion 22 that extends in a side-ways or circumferential direction about the tip of the tool. In the exemplary embodiment, five such hooks 16 are provided, circumferentially spaced (by about 60°) about the periphery of the leg 16. The slot 18 would otherwise accommodate a sixth hook (see FIG. 4). In other words, the hooks are spaced at regular intervals except that the slot 18 remains open. The shorter leg 14 is simply machined flat at its opposite ends, but also includes an open ended slot 24 extending from one end approximately half the length of leg 14, again to accommodate TC leads.

Figure 3:
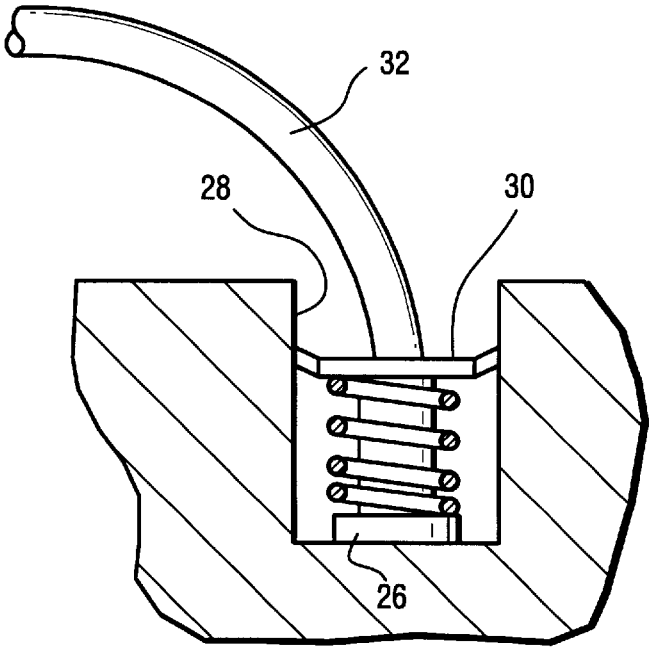
Fig. 3 (PRIOR ART)
FIG. 3 is a schematic diagram of a thermocouple and star-washer of the type that can be installed and removed using the tool shown in FIGS. 1 and 2.

In use, and with reference to FIG. 3, leg 14 is used as the tool component during installation of the TC 26, with leg 12 serving as a handle. The diameter of leg 14 is sized to slip-fit inside the hole 28, and is used to push the star-washer 30 down into the hole, with the center of the star-washer remaining substantially flat, and without destroying or damaging the lead 32 of the TC 26, which is accommodated in the slot 24.

To remove the star-washer 30 and thus enable removal of the TC 26, the longer or first leg 12 is used as the tool component and the shorter or second leg 14 as the handle. The leg 12 is inserted into the hole 26, and oriented such that hooks 16 pass through the spaces between the radially extending tips of the star-washer 30. With a slight rotation via leg 14, the hooks 16 engage the washer tips, enabling the washer to be pulled out of the hole 26. The TC lead 30 is accommodated by the slot 18 in the removal process.

The tool 10 may be constructed in various sizes as needed. Alternatively, the working ends of the respective legs or tubes may be threadably secured to each other or to base sections (for example, a T-adapter), so that working ends of different diameters can be installed and used for holes and thermocouples of larger diameters.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A tool for removal of a star-washer from a bore comprising a handle; and a tool component secured to the handle, said tool component having a distal end with an elongated slot extending from said distal end rearwardly toward said handle, and a plurality of hooks circumferentially spaced about said distal end, said hooks located at regular intervals about said distal end except that one such interval is occupied by said slot and remains open through said distal end.

2. The tool of claim 1 wherein each hook includes a forwardly projecting stem and a sideways facing tip.

3. The tool of claim 1 wherein said handle extends perpendicularly to said tool component.

4. The tool of claim 3 wherein said handle comprises a hollow tube, one end of said hollow tube formed with said elongated slot.

5. A tool for removal of a star-washer from a bore comprising a handle; and a tool component secured to the handle, said tool component having a distal end with an elongated slot extending from said distal end rearwardly toward said handle, and five hooks circumferentially spaced about said distal end.

6. A tool for installation and removal of a star-washer in a bore comprising: a first tubular leg; and a second leg secured to the first tubular leg substantially perpendicularly thereto, said first tubular leg having a distal end with a first elongated slot extending from said distal end rearwardly toward said second tubular leg, and a plurality of hooks circumferentially spaced about said distal end of said first tubular leg; and wherein said second tubular leg is formed with a second elongated slot extending from one end of said second tubular leg toward said first tubular leg, and further wherein said second tubular leg is utilized to push the star-washer down into the bore, and the second tubular leg and said hooks are utilized to pull the star-washer out of the bore.

7. The tool of claim 6 wherein said first and second legs are welded together.

8. The tool of claim 6 wherein said first elongated slot has a length about half the length of said first tubular leg.

9. The tool of claim 6 wherein said second elongated slot has a length about half the length of said second tubular leg.

* * * * *